US005765731A

United States Patent [19]

Callian

[11] Patent Number: 5,765,731

[45] Date of Patent: Jun. 16, 1998

[54] THIMBLE

[76] Inventor: Devilyn G. Callian, 4251 Brookside, Irvine, Calif. 92714

[21] Appl. No.: 568,988

[22] Filed: Dec. 7, 1995

[51] Int. Cl.[6] ..... D05B 91/04

[52] U.S. Cl. ..... 223/101; 2/21; 602/22

[58] Field of Search ..... 223/101, 99; 2/21; 602/22, 61

[56] References Cited

U.S. PATENT DOCUMENTS

| | | | |
|---|---|---|---|
| 1,980,635 | 11/1934 | Rasmussen et al. | 2/21 |
| 2,717,799 | 9/1955 | Jones | 2/21 |
| 2,847,005 | 8/1958 | Bourne | 2/21 |
| 2,875,758 | 3/1959 | Fuzak et al. | 602/58 |
| 3,191,824 | 6/1965 | Burr | 223/101 |
| 3,531,029 | 9/1970 | Lee . | |
| 4,127,222 | 11/1978 | Adams . | |
| 4,239,134 | 12/1980 | Joy . | |
| 4,694,508 | 9/1987 | Iriyama | 2/21 |
| 4,754,750 | 7/1988 | Imonti | 602/58 |
| 4,944,437 | 7/1990 | Calvert . | |
| 5,085,234 | 2/1992 | Silverman | 2/21 |
| 5,172,424 | 12/1992 | Adkins | 2/21 |
| 5,354,261 | 10/1994 | Clark et al. | 602/58 |

FOREIGN PATENT DOCUMENTS

| | | | |
|---|---|---|---|
| 647454 | 8/1962 | Canada | 602/58 |
| 580420 | 8/1958 | Italy | 602/58 |

*Primary Examiner*—Bibhu Mohanty

[57] ABSTRACT

A thimble for use in quilting, sewing or the like to manipulate a needle includes a flexible member and a shield member. The flexible member has four notches in spaced apart relation forming four tab portions positioned therebetween. The notches enable the tab portions to be bent about a finger of a person for conforming and fitting the thimble to the finger. One of the tab portions may be elongated to provide an elongated flap for fitting the thimble on a finger with a long fingernail. The flexible member is attached to or integrally formed with an adhesive material for securing the thimble to the finger of a person to prevent slippage of the thimble. The thimble further includes a shield member attached to the adhesive material of the flexible member for protecting the finger from contact with the needle. The shield member includes a dimple for seating the needle during use of the thimble and a curved surface for conforming to the finger of a person.

1 Claim, 1 Drawing Sheet

THIMBLE

BACKGROUND OF THE INVENTION

1. Field of the Invention

The present invention relates to thimbles and, more particularly, to a quilting thimble having an adhesive material for finger attachment and having a shield insert for contact with a needle.

2. Prior Developments

Thimbles have been used for sewing as a protective cover for a finger of a person. A variety of types of thimbles exist, such as leather, porcelain, and metal thimbles of various sizes to cover the finger tip of different sized fingers. However, the metal or hard shelled thimbles do not conform to the finger of the person and must be a tight fit to prevent the thimble from falling off of the finger. As a result, the metal type thimble may injure the finger or fingernail after extended use and may not properly fit every size of finger, resulting in an uncomfortable fit and inadequate usage of the thimble during stitching, such as slippage of the thimble, or the like.

A wraparound thimble is disclosed in U.S. Pat. No. 3,531,029 to Lee which is formed from a metal blank and has a gap for providing adjustability of the thimble to different sized fingers. The thimble also has knobs on an inner surface in an attempt to overcome slippage of the thimble on the thimble finger. However, the rigid material of the thimble may provide an uncomfortable and inadequate fit for certain sized fingers.

U.S. Pat. No. 4,127,222 to Adams, U.S. Pat. No. 4,944,437 to Calvert and U.S. Pat. No. 4,239,134 to Joy disclose thimbles formed from a flexible or pliable material for conforming to the finger of a person. The thimbles include a rigid member for protecting the finger from sharp objects, such as a needle. The thimbles also provide for fitting various lengths of fingernails of the user of the thimble. However, the thimbles do not provide for a means for preventing slippage of the thimble on the finger and would have to be produced in various sizes for accommodating different sized fingers.

Therefore, there has existed a need for a thimble having an adhesive material for adhering to a persona's finger to prevent slippage of the thimble and provide a comfortable fit, having a plurality of notches in spaced apart relation for adjusting the shape of the thimble for various sized fingers, and having a shield member for protecting the finger tip from a needle.

SUMMARY OF THE INVENTION

The present invention relates to a thimble including a flexible member having a first surface, a second surface, and an edge. One of the first and second surfaces having thereon an adhesive for securing the thimble to a finger of a person. The flexible member has at least one notch defined in the edge thereof for enabling the thimble to conform to various sized fingers. The thimble also includes a shield member attached to the adhesive for preventing penetration of sharp objects to protect the finger of the person.

The shield member may define at least one dimple for engaging a needle, and a curved surface for conforming to the finger of the person. Preferably, the flexible member includes four notches in spaced apart relation along the edge of the flexible member forming four tab portions for enabling the flexible member to conform to a finger tip of the person. One of the tab portions may be sized and adapted to cover a fingernail of the person.

DESCRIPTION OF A PREFERRED EMBODIMENT OF THE INVENTION

Figure 1:
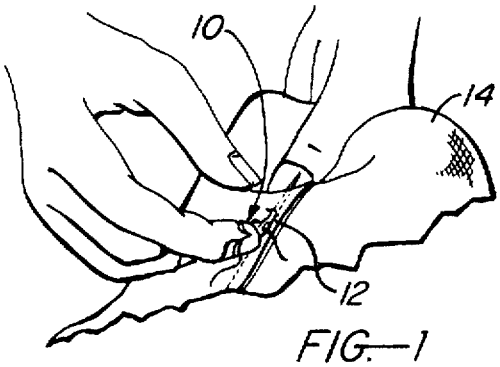
FIG. 1 is a perspective view showing the hands of a person employing a thimble according to the present invention.
Figure 4:
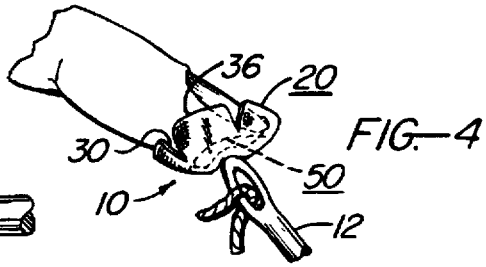
FIG. 4 is a perspective view of the thimble positioned on a finger of the person and contacting a needle.
Figure 6:
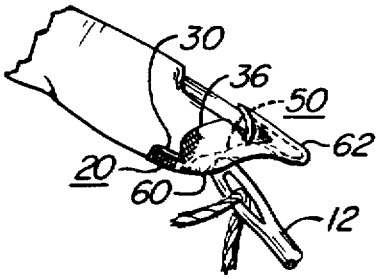
FIG. 6 is a perspective view of the thimble of FIG. 5 positioned on the finger of the person and contacting the needle.

Referring to FIGS. 1, 4 and 6, a thimble 10 is shown positioned on a finger of a person, such as an index finger or middle finger. The thimble 10 prevents contact of the finger of the person with a needle 12 during quilting, sewing, or any other practice which requires stitching. The thimble 10 is used to contact the needle 12 to push the needle 12 through the material 14. During quilting, several layers of material, such as the top fabric, batting and backing, are sewn together to form the quilt. The plurality of layers restrict the directing and forceful pushing of the needle 12 through the material 14, and continual quilting without the use of the thimble 10, will cause discomfort and injury to the finger of the quilter.

Figure 2:
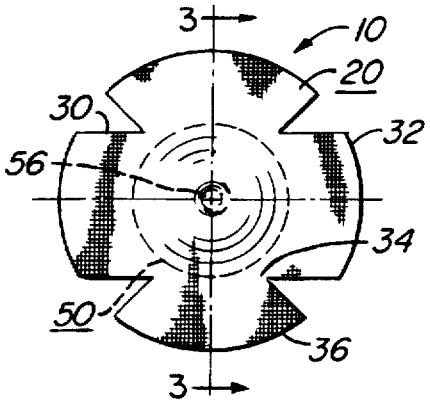
FIG. 2 is a plan view of the thimble.
Figure 3:
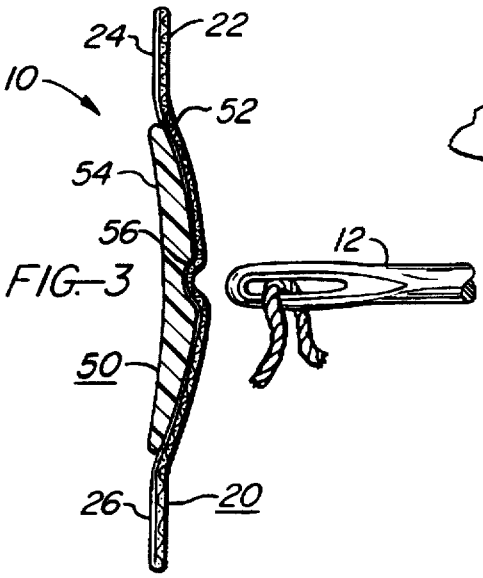
FIG. 3 is a view taken along line 3—3 of FIG. 2.

Referring to FIGS. 2 and 3, the thimble 10 includes a flexible member 20 having a first surface 22 and a second surface 24. One of the first and second surfaces 22 and 24, such as the second surface 24, carries an adhesive material 26 for adhering to the finger of the person. As an alternative to the adhesive material 26 being integrally formed with the flexible member 20, the adhesive material 26 may be attached to the flexible member 20. The thimble 10 may be constructed from a fabric or material, such as adhesive rubber, thin plastic, or the like. The flexible member 20 may be disk shaped, oval shaped, circular, rectangular, or the like.

The flexible member 20 of the thimble 10 includes at least one notch 30 positioned along an edge 32. The notch 30 may be a V-shaped cut out portion for enabling the thimble 10 to be bent or formed into various shapes. Preferably, the thimble 10 includes four notches 30 in spaced apart relation along the edge 32 for enabling the thimble 10 to fit on various sized fingers. The flexible member 20 includes a central portion 34, and tab portions 36 positioned between adjacent notches 30 and formed by the notches 30.

The thimble 10 further includes a shield member 50, which has a first side 52 and a second side 54. One of the first and second sides 52 and 54, such as the first side 52, is attached to the adhesive material 26 of the flexible member 20 and has a dimple 56. The dimple or recess 56 is engagable with the needle 12 for seating the needle 12 on the thimble 10 for preventing slippage of the needle 12 while stitching. The other of the first and second sides 52 and 54, such as the second side 54, may have a curved surface for providing a comfortable fit.

The shield member 50 may be disk shaped, oval shaped, circular, or the like, and may be formed from plastic, recycled plastic, metal, or the like. The shield member 50 is sized and adapted to substantially cover the finger tip of the finger for protecting the finger from sharp objects, such as a head of the needle 12.

For the various embodiments of this invention, the same reference characters will be used to designate like parts. In addition, like functions and like interactions of the parts among the various embodiments of this invention will not be repeated for each embodiment.

Figure 5:
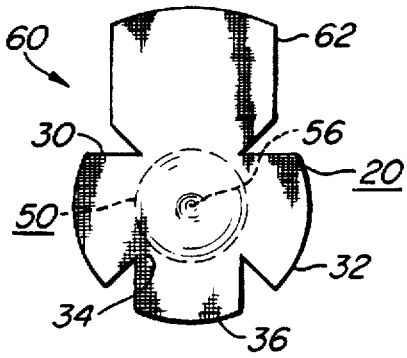
FIG. 5 is an alternative embodiment of the thimble having an enlarged flap portion for covering a fingernail of the person.

Referring to FIGS. 5 and 6 and using the same reference characters to define like parts, an alternative embodiment of the thimble 10 as illustrated in FIGS. 2 and 4 may be a thimble 60 having like parts as thimble 10 and additionally having at least one of the tab portions elongated to provide a flap 62 for accommodating various lengths of fingernails of the person.

To use the thimbles 10 and 60, the thimble 10 or 60 is positioned over the desired finger with the shield member 50 centered over the tip of the finger. The four tab portions 36 of the adhesive backed material are pressed about the sides of the finger tip and fingernail so that the thimble 10 or 60 is held securely in place. The needle 12 is positioned at the desired spot on the fabric, and the dimple 56 on the shield member 50 serves to push and guide the needle 12 through all layers of the fabric. After use of the thimbles 10 and 60, the thimbles 10 and 60 may be discarded and a new thimble 10 and 60 used, for keeping the secure fit.

Several advantages of the thimbles 10 and 60 with notched edges made of adhesive material are that the thimbles 10 and 60 provide a comfortable fit, protect the finger, and prevent shifting. Standard thimbles are often too large and can shift. The notches 30 allow the thimbles 10 and 60 to be adjusted to any size finger.

The thimble 60 can be worn by a person with long fingernails because the tab portions will adhere about various lengths of fingernails. The person can position the insert or shield member 50 in the desired location for protecting the finger and providing comfort without having the thimble 60 shift during use.

Thus there has been shown and described a novel thimble which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. An adhesive thimble for a finger used in sewing comprising:

a central portion of flexible material sized to cover a tip of a finger of a person and to extend over the fingertip, said central portion having attached thereto at least three tabs of substantially the same size to extend over the sides of the finger and one tab of a longer length for extending over a fingernail, the plurality of tabs and central portion having adhesive on one side thereof to fasten the thimble to the fingertip;

and a thin substantially flat shield member made from a hard plastic or metal which is substantially impenetrable by a sewing needle head; said shield member being substantially the same size as the central portion and attached thereto by the adhesive means;

and a single central dimple placed on the shield member and central portion to retain a sewing needle head therein against relative movement to the shield.

* * * * *